US011123646B1

(12) United States Patent
Amor

(10) Patent No.: US 11,123,646 B1
(45) Date of Patent: Sep. 21, 2021

(54) ELECTRONIC SCREEN HOLDER DEVICE AND METHOD

(71) Applicant: Max Innovations, Inc., Chula Vista, CA (US)

(72) Inventor: Andrea Michelle Zepol Amor, Glendale, CA (US)

(73) Assignee: Max Innovations, Inc., Chula Vista, CA (US)

( * ) Notice: Subject to any disclaimer, the term of this patent is extended or adjusted under 35 U.S.C. 154(b) by 0 days.

(21) Appl. No.: 16/906,200

(22) Filed: Jun. 19, 2020

(51) Int. Cl.
*A63H 3/02* (2006.01)
*A45C 11/00* (2006.01)
*A63H 3/00* (2006.01)

(52) U.S. Cl.
CPC ..... *A63H 3/02* (2013.01); *A45C 11/00* (2013.01); *A63H 3/003* (2013.01); *A45C 2011/002* (2013.01); *A45C 2011/003* (2013.01)

(58) Field of Classification Search
CPC ..... A63H 3/02; A63H 3/003; A45C 11/00; A45C 2011/002; A45C 2011/003
USPC ..... 446/71–74, 81, 297, 330, 340
See application file for complete search history.

(56) References Cited

U.S. PATENT DOCUMENTS 2,078,809 A * 4/1937 Richman ..... A63H 3/12 446/74
4,917,607 A * 4/1990 Van Hoose ..... A63H 3/003 434/236
5,046,980 A * 9/1991 Tai ..... A63H 3/003 446/73
5,059,149 A * 10/1991 Stone ..... A63H 3/003 446/73
5,326,300 A * 7/1994 Sonders ..... A45C 15/00 190/1
5,601,469 A * 2/1997 Yang ..... A63H 3/003 411/339
5,807,155 A * 9/1998 Divvleeon ..... A63H 3/003 446/369
6,146,722 A * 11/2000 Slawin ..... A47G 1/0616 40/791
D715,805 S * 10/2014 Hilton ..... D14/447
D716,642 S * 11/2014 Harges ..... D8/380
9,968,861 B2 * 5/2018 Brown, Sr. ..... A63H 3/02
2005/0227577 A1 * 10/2005 McRae ..... A63H 3/02 446/268
2012/0309256 A1 * 12/2012 Theodore ..... A63H 3/02 446/72
2013/0095725 A1 4/2013 Von Mohr et al.
2015/0133022 A1 * 5/2015 Ushiba ..... A63H 3/02 446/73
2015/0174498 A1 * 6/2015 Hilton ..... A63H 3/02 446/73

(Continued)

OTHER PUBLICATIONS

Amazon.com [online], "Chimps Monkey Phone Holder—stuffed Animal by Ty," Dec. 11, 2015, retrieved on Oct. 21, 2020, retrieved from URL <https://www.amazon.com/Chimps-Monkey-Phone-Holder-stuffed/dp/B0158VT1LY/ref=sr_1_50?dchild=1&keywords=ipad+stuffed+animal&qid=1589391683&sr=8-50>, 5 pages.

(Continued)

*Primary Examiner* — Nini F Legesse
(74) *Attorney, Agent, or Firm* — Fish & Richardson P.C.

(57) ABSTRACT

An improved electronic screen holder device comprising a concave recess for retaining a mobile screen device and, optionally, a sliding connector.

13 Claims, 5 Drawing Sheets

(56) References Cited

U.S. PATENT DOCUMENTS

2015/0283469 A1* 10/2015 Barnes ..... A63H 3/02
446/369

OTHER PUBLICATIONS

Amazon.com [online], "Please Confirm Compatible with Tablet Before Purchase Tabbeez Stuffed Animal Tablet Pillow / Toy / Holder—Alexa Unicorn for 8" and 10" Tablets IPad / iPad Mini / Does NOT Work with New IPAD PRO," Jan. 5, 2016, retrieved on Oct. 21, 2020, retrieved from URL <https://www.amazon.com/Tabbeez-Stuffed-Animal-Tablet-Pillow/dp/B00QQX920E>.

Amazon.com [online], "Tabbeez Please Confirm Compatible BEFOR Buying Tablet Pet—Goldie Plush Toy/Tablet Cover/Pillow / Holder for 8" & 10" Tablets / IPad, IPad 2, 3,,4, 5 6 / IPad Mini NOT Compatible with IPAD PRO," Dec. 7, 2014, retrieved on Oct. 21, 2020, retrieved from URL <https://www.amazon.com/Tabbeez-Kids-Tablet-Pet-Toy/dp/B00NS6ATP4/ref=sr_1_6?dchild=1&keywords=ipad+stuffed+animal&qid=1589391646&sr=8-6>, 7 pages.

Pinterest.com [online] "cuteinthebox.com," 2017, retrieved on Oct. 21, 2020, retrieved from URL <https://www.pinterest.com/pin/363454632403507822/>, 2 pages.

* cited by examiner

ELECTRONIC SCREEN HOLDER DEVICE AND METHOD

TECHNICAL FIELD

This disclosure relates to an electronic screen holder device and its method of use.

BACKGROUND

Mobile devices with electronic screens, including smartphones, tablets, and other mobile screen devices, are used in a wide variety of applications for both adults and children. Such mobile screen devices are often carried by hand, in a pocket, or stored in a purse, backpack, stroller, or other such carrying device. Depending on the size of the device, it may be difficult for the user, especially a child, to hold the device comfortably. In some instances, this may cause the user to drop the device, potentially cracking the screen or otherwise damaging the device. During use, mobile screen devices may also become hot to the touch, making them uncomfortable to hold with bare hands.

Similarly, users may want to position the mobile screen device on a surface, such as with a stand, to allow upright positioning of the device without holding it in the user's hands. For example, a parent may wish to set a mobile screen device on a surface of a child stroller to play a video for a child seated in the stroller. As another example, a user may wish to place the device on their lap to watch a television show without holding the device throughout the entire show. However, depending on the supporting surface, it may be difficult to balance the screen device, or the stand may require frequent adjustment during use to prevent dropping or falling over of the mobile screen device.

SUMMARY

Some embodiments described herein include an improved electronic screen holder device for securing and protecting a mobile screen device during use and transport. In particular embodiments, the electronic screen holder device may be incorporated into a plush or other soft textile. For example, the improved electronic screen holder device may be embodied as part of a stuffed animal for use by small children. In other embodiments, such as those directed to adults or adolescents, the improved electronic screen holder device may be embodied as part of a backpack, purse, or tote. Such holders allow the user to easily grasp the electronic screen holder device in their hands, or to place it on a number of surfaces, including uneven surfaces during use and lessen the chance that the mobile screen device is dropped, damaged, or falls out of position. In some embodiments, weighted filling may be added to one or more sections of the electronic screen holder device in order to provide balance to the device and an ergonomic feel to the user. The electronic screen holder device may also allow the user to access and use the mobile screen device without the same level of discomfort from directly holding a hot or warm mobile screen device.

Mobile devices with electronic screens may include a variety of sizes and form factors, including phone-sized devices, to tablets, to electronic readers, to gaming devices, to other mobile screen devices. In some embodiments, the electronic screen holder device described herein may be configured to secure mobile screen devices of varying sizes and shapes. For example, the electronic screen holder device may optionally contain a coverable recess for retaining a phone-sized electronic screen device. In certain embodiments, such as, for example, a stuffed animal, the coverable recess may be located in the stomach or body of the stuffed animal. In some embodiments, the recess is concave shaped so as to allow the mobile screen device to sit within the recess when attached to the electronic screen holder device. The mobile screen device may be attached to the recess in some embodiments with clips or tabs that connect to the sides or corners of the mobile screen device. Optionally, the tabs or clips may be connected to a ratchet mechanism in the concave recess to allow rotation of the mobile screen device within the recess, so that the user may selectively adjust the screen between a landscape orientation and a portrait orientation without removing it from the electronic screen holder device. In such embodiments, the concave recess may be in the form of a half sphere so as to allow rotation of the ratchet and connected mobile screen device within the concave recess.

In certain embodiments, the concave recess may further include a cover for the recess. The cover may be attached to the electronic screen holder device at one point, and releasably securable to the concave recess with a zipper, snap, magnets, hook-and-loop fastener, or other means. The cover may be made of a transparent or non-transparent material or a combination thereof. In some embodiments, a multi-layer cover may be used. In such embodiments, the user may cover the device for storage, or for added protection during transport without having to remove the mobile screen device from the electronic screen holder device. In some embodiments, the electronic screen holder device may further include a cover retainer such as a clip, magnet, or hook-and-loop fastener for securing the cover in the open position when the user wishes to access the mobile screen device. For example, in embodiments where the electronic screen holder device a plush stuffed animal, the plush stuffed animal may have a clip in its mouth for holding an edge of the cover when the cover is in the open position.

Certain embodiments of an improved electronic screen holder device may further include a mechanism for retaining larger mobile screen devices, such as tablet-style devices. For example, some embodiments may include a sliding connector for securing the bottom edge of the mobile screen device. In other embodiments, the sliding connector may be positioned to engage with a different edge of the mobile screen device (e.g., such as located in the mouth of a plush stuffed animal), or multiple sliding connectors may be used. Such sliding connectors may be sized to securely grip one or more edges of the mobile screen device without requiring removal of any covers or keyboards that the user may have already placed on the screen. Particular embodiments may further include clips or tabs for securing another edge or edges or corners of a mobile screen device. For example, in an embodiment where the improved electronic screen holder device is a plush stuffed animal, the sliding connector may be located on the stomach or lower end of the stuffed animal, and the clips or tabs may be located on the shoulders, arms, or hands of the stuffed animal to give the visual impression that the stuffed animal is holding the mobile screen device. In some embodiments, the electronic screen holder device may further include extendable supports for raising one edge of the mobile screen device during use to provide the user with ergonomic access to the mobile screen device.

Some embodiments may further include a flexible cover for covering the mobile screen device when desired to prevent damage and allow for secure transport of the electronic screen device holder and mobile screen device. For example, some embodiments may include a recessed pocket for holding a flexible cover, and the flexible cover may be extendable from the recessed pocket to connect to the clips and tabs, the sliding connector, the electronic screen device, or a combination thereof.

The improved electronic screen holder device may further include additional pockets or storage compartments. For example, the device may in some implementations have one or more zipper pockets for holding headphones, charging cables, and other accessories for the mobile screen device, or other of the user's possessions. In some embodiments, the electronic screen holder device may include a pocket for transport of the mobile screen device when not attached to one of the mobile screen device retention mechanisms. In certain embodiments, such as backpack or purse designs, the improved electronic screen holder device may further include carrying straps or hooks for ease of transport.

Particular embodiments described herein include an improved electronic screen holder device comprising a body defining a recess. In some embodiments, the electronic screen holder device may include mobile screen device connector tabs located within the recess for securing a mobile screen device to the body. Certain embodiments may also include a retractable cover releasably attached to the recess and a cover retaining clip for securing one edge of the retractable cover and holding the retractable cover when the retractable cover is in the open position. Some embodiments described herein may optionally include a slidable insert for securing an edge of a second mobile screen device to the body.

Some embodiments described herein include a method of using an improved electronic screen holder device, including the step of opening a retractable cover of an electronic screen holder device to access a recess defined by a body of the electronic screen holder device. Some embodiments may also include the step of attaching the retractable cover to a cover retaining clip for securing one edge of the retractable cover and holding the retractable cover when the retractable cover is in the open position. The method may optionally include the step of securing the mobile screen device to electronic screen connector tabs located within the recess. Finally, some embodiments of the method may include the step of closing the retractable cover of the electronic screen holder device.

Some embodiments of an improved electronic screen holder device may be in the form of a children's plush stuffed animal and may include a body, having a head portion, torso portion, two leg portions, and two arm portions. The improved electronic screen holder device may optionally comprise a recess located in the torso portion and mobile screen device connector tabs located within the recess for securing a mobile screen device to the body. Certain implementations may include a retractable cover releasably attached to the recess and/or a cover retaining clip located on the head portion for securing one edge of the retractable cover and holding the retractable cover when the retractable cover is in the open position. In some embodiments, the improved electronic screen holder device may have a slidable insert for securing an edge of a second mobile screen device to the torso portion.

A number of embodiments described herein may provide one or more of the following advantages. First, some embodiments provide a plush or other soft textile electronic screen holder device for securing a mobile screen device for use and transport. As such, the electronic screen holder device may be placed on a number of surfaces, and may be easy to hold and use. Second, the improved electronic screen holder device may optionally include a concave recess for retaining a mobile screen device. The concave recess may advantageously allow the mobile screen device to be used or covered without removing the mobile screen device from the electronic screen holder device, and optionally may further include a ratchet system to allow rotation of the electronic device within the concave recess for viewing multiple different orientations. Third, the improved electronic screen holder device may optionally include a sliding connector and tabs for securing larger, tablet-sized mobile screen devices to the device, and may optionally further include a flexible cover to cover such mobile screen devices during transport, protecting the mobile screen device from damage.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
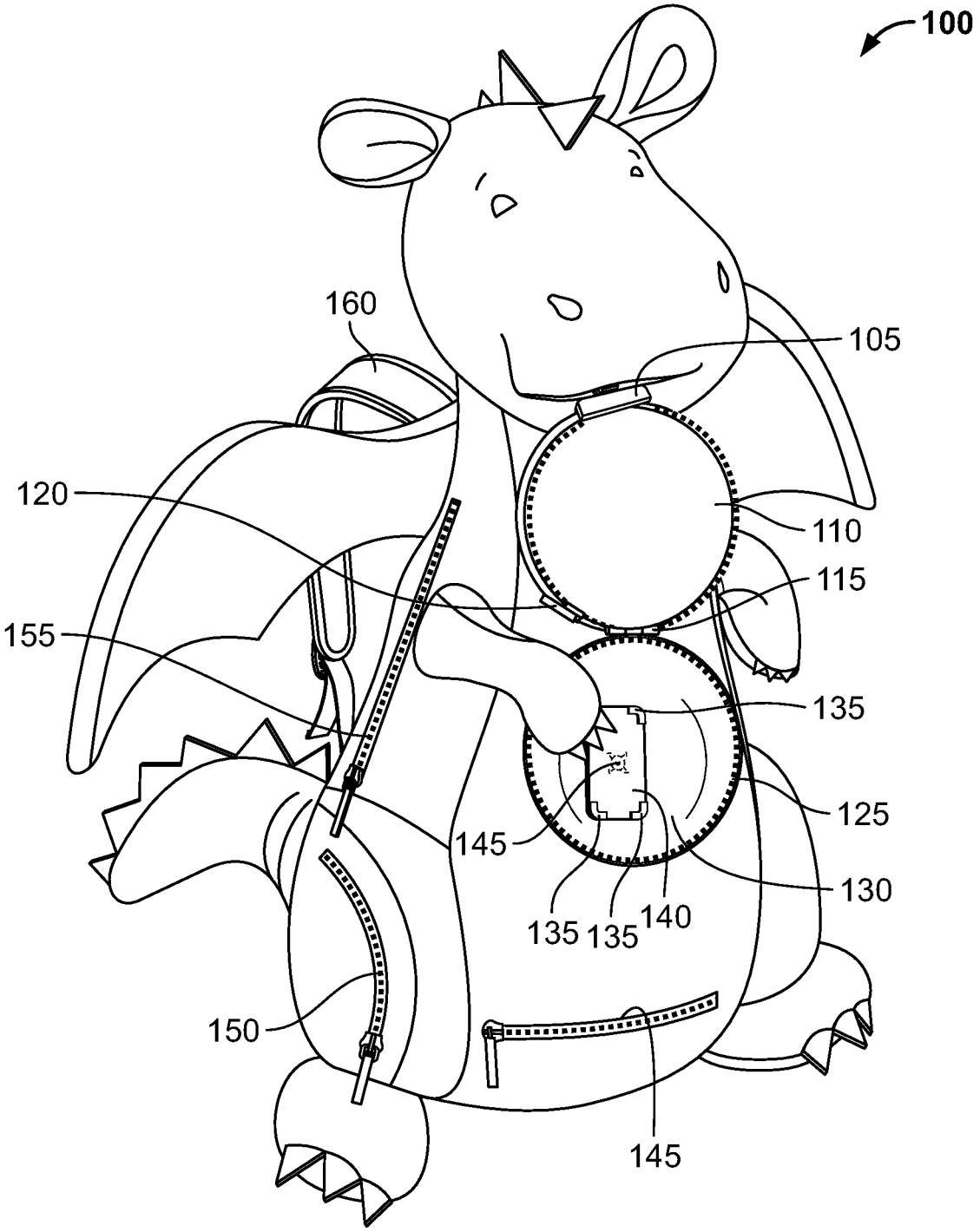
FIG. 1 shows a perspective view of an embodiment of an improved electronic screen holder device.

Referring now to FIG. 1, some embodiments of electronic screen holder device 100 are configured to hold a mobile screen device within a plush or stuffed animal. Although depicted as a stuffed dragon in FIG. 1, electronic screen holder device 100 may be embodied in other stuffed animals or plush characters. In still further embodiments, electronic screen holder device 100 may take the form of a purse, backpack, briefcase, or other carrying device.

As shown in FIG. 1, improved electronic screen holder device 100 may include a concave recess 130. As shown in FIG. 1, concave recess 130 may take the form of a cavity within improved screen holder device 100, and may contain mobile screen device holder 140 for holding a mobile screen device. In some embodiments, concave recess 130 may be roughly the shape of a half sphere, so as to allow mobile screen device holder 140 to hold a mobile screen device in various orientations, such as in either the landscape or portrait orientation. In other embodiments, concave recess 130 may be shaped so as to hold a mobile screen device in only the portrait, or only the landscape orientation.

In some embodiments, electronic screen holder device 100 may further include a cover 110 for covering concave recess 130 during transport or storage. In some embodiments, such as shown in FIG. 1, cover 110 may be hingedly connected to concave recess 130 by hinge 115, so as to allow the user to open and close cover 110 without the risk of losing the cover or having to store the cover elsewhere when it is in the open position. As shown in FIG. 1, cover 110 may be releasably connected to concave recess 130 by a zipper 120 on cover 110 (and corresponding zipper 125 on concave recess 130) to hold cover 110 in the closed position. In other embodiments, cover 110 may affix to concave recess 130 through other means, such as hook-and-loop fasteners, magnets, or clips.

As further shown in FIG. 1, some embodiments of electronic screen holder device 100 may include retainer 105 for holding one edge of cover 110 when cover 110 is in the open position, so as to prevent cover 110 from falling to the closed position or otherwise interfering with a user's operation of improved screen holder device 100. In FIG. 1, retainer 105 is shown as a clip, but in other embodiments retainer 105 may be another suitable retention mechanism, such as a magnet or hook-and-loop fastener. Further, although retainer 105 is shown in FIG. 1 as a portion of the stuffed animal's mouth, it may be located in other positions or orientations as desired, depending on the form of electronic screen holder device 100.

As mentioned above, certain embodiments of electronic screen holder device 100 may include mobile screen device holder 140 within concave recess 130 for holding a mobile screen device. Although shown as phone-sized in FIG. 1, mobile screen device holder 140 may be sized to fit different sizes of mobile screen devices and form factors. In some embodiments, mobile screen device holder 140 may include tabs 135 for connecting to and holding the corners of an electronic device. In other embodiments, tabs 135 may be positioned to hold the sides of an electronic device, rather than the corner. In still further embodiments, tabs 135 may comprise a single tab configured to engage with the perimeter of an electronic device.

In particular embodiments, mobile screen device holder 140 may further comprise a ratchet 145, coupling mobile screen device holder 140 to concave recess 130. In such embodiments, ratchet 145 may be configured to allow rotation of mobile screen device holder 140 from the landscape to portrait orientation, from portrait to landscape orientation, or to other orientations in between. In some embodiments, mobile screen device holder 140 may be constructed from partially transparent materials so as to allow the user (e.g., a child) to see the operation of ratchet 145, or ratchet 145 may be sized such that it is visible to the user when a mobile screen device is connected to mobile screen device holder 140.

Some embodiments of electronic screen holder device 100 may further include pockets 145, 150, and/or 155 for retaining a user's possessions. For example, a user may store accessories such as headphones and charging cables in one of pockets 145, 150, or 155. In some embodiments, pockets 145, 150, and 155 may be releasably closable through use of a zipper, whereas other embodiments may use a magnet, hook-and-loop fastener, or clip. Still further embodiments may omit the closing mechanism and instead leave one or more of pockets 145, 150, and 155 as open. As further shown in FIG. 1, some embodiments of electronic screen holder device 100 may further include carrying strap 160.

Figure 2:
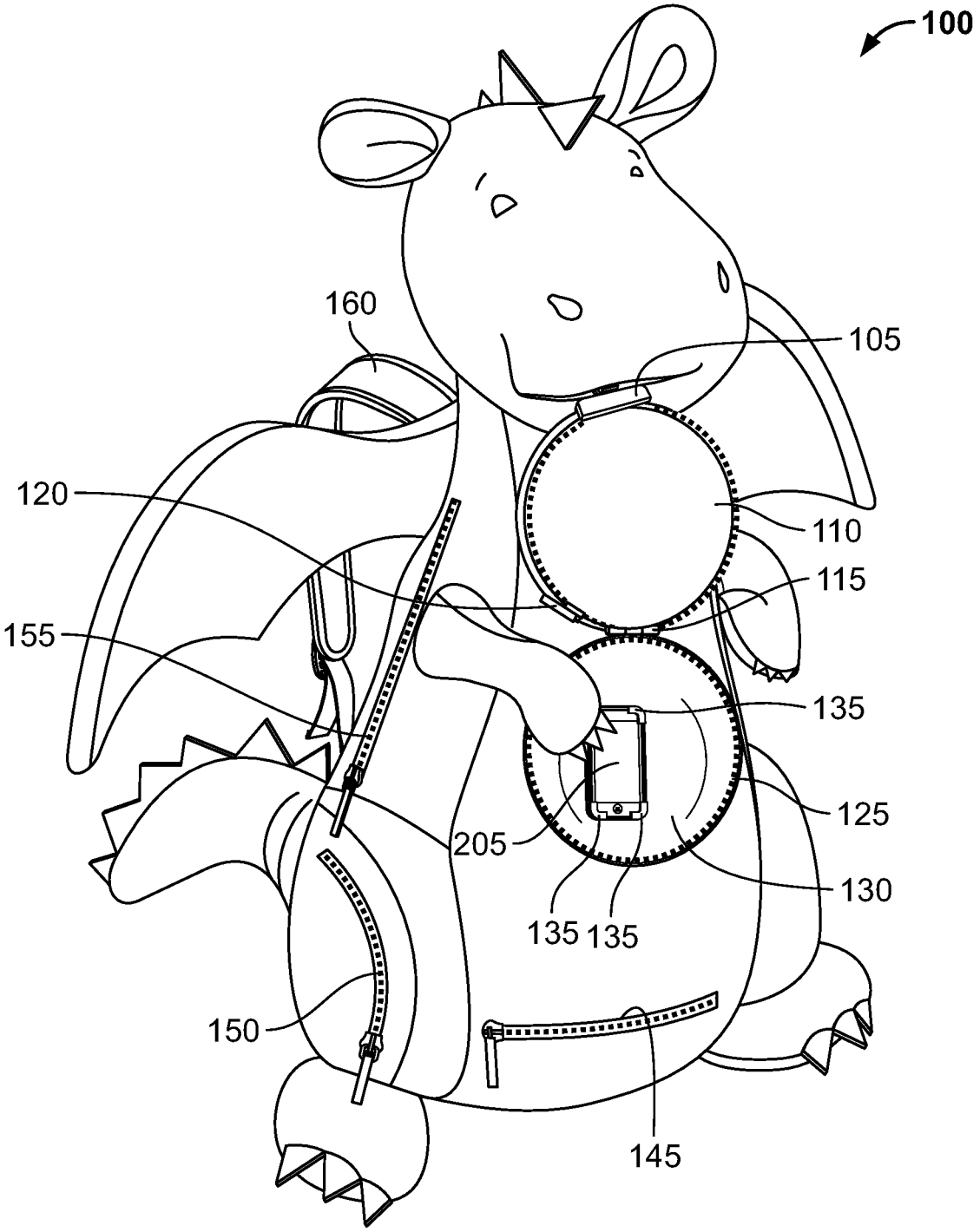
FIG. 2 shows another perspective view of the embodiment of FIG. 1 including a mobile screen device.

FIG. 2 shows an embodiment of electronic screen holder device 100 holding a mobile screen device 205. As shown in FIG. 2, tabs 135 engage with the corners of mobile screen device 205 in this embodiment to hold mobile screen device 205 on mobile screen device holder 140 within concave recess 130.

Figure 3:
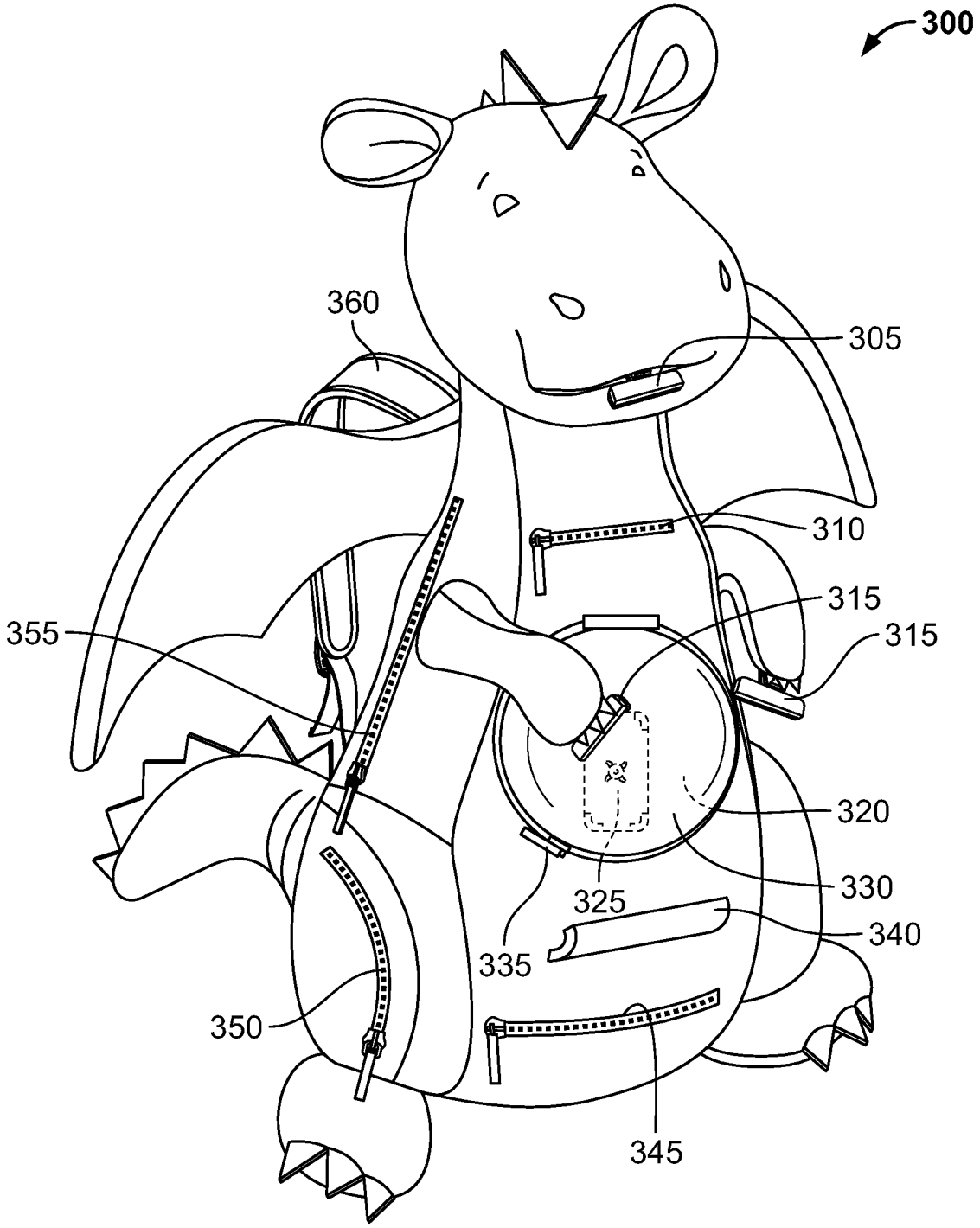
FIG. 3 shows a perspective view of alternative embodiment of an improved electronic screen holder device.

Referring now to FIG. 3, an alternative embodiment of improved electronic screen holder device 300 is shown. Like the embodiments shown in FIGS. 1 and 2, the embodiment depicted in FIG. 3 includes a concave recess 320, with a mobile screen device holder 325 located within. As shown in FIG. 3, electronic screen holder device further includes a cover 330, which is releasably attachable to concave recess 320 by a zipper 335. In FIG. 3, cover 330 is shown in the closed position. When cover 330 is in the open position, it may be retained in that position by retainer 305. In some embodiments, such as shown in FIG. 3, electronic screen holder device 300 comprises pockets 345, 350, and 355, as well as carrying strap 360.

Still referring to FIG. 3, some embodiments of electronic screen holder device 300 may include an additional mobile screen device holder for holding a screen with a larger form factor than can be accommodated by mobile screen device holder 325 within concave recess 320. For example, certain embodiments of electronic screen holder device 300 may include a sliding connector 340 for engaging with one edge of a mobile screen device and holding the mobile screen device against electronic screen holder device 300. Sliding connector 340 may be configured with elastic material or otherwise biased to impart a gripping force against a mobile screen device to hold one edge of the mobile screen device in place. Sliding connector 340 may be sized so as to accommodate mobile screen devices where the user has applied a cover or other carrying device to the mobile screen device.

As shown in FIG. 3, some embodiments of electronic screen holder device 300 may further include one or more screen retainers 315 for engaging with the mobile screen device. For example, a user may slide one edge of a mobile screen device into sliding connector 340, and then engage another edge or corner of the mobile screen device with one or more screen retainers 315 to secure the mobile screen device to electronic screen holder device 300. Although screen retainers 315 are shown as clips in FIG. 3, in other embodiments screen retainers 315 may be tabs, snaps, magnets, or hooks. In some embodiments, screen retainers 315 may be incorporated into a portion of the electronic screen device holder so as to be hidden from view (e.g., incorporated into the hands of a stuffed animal). As described in more detail in connection with FIG. 5, electronic screen holder device 300 may also include a flexible cover stored within pocket 310 for covering a mobile screen device during transport or storage.

Figure 4:
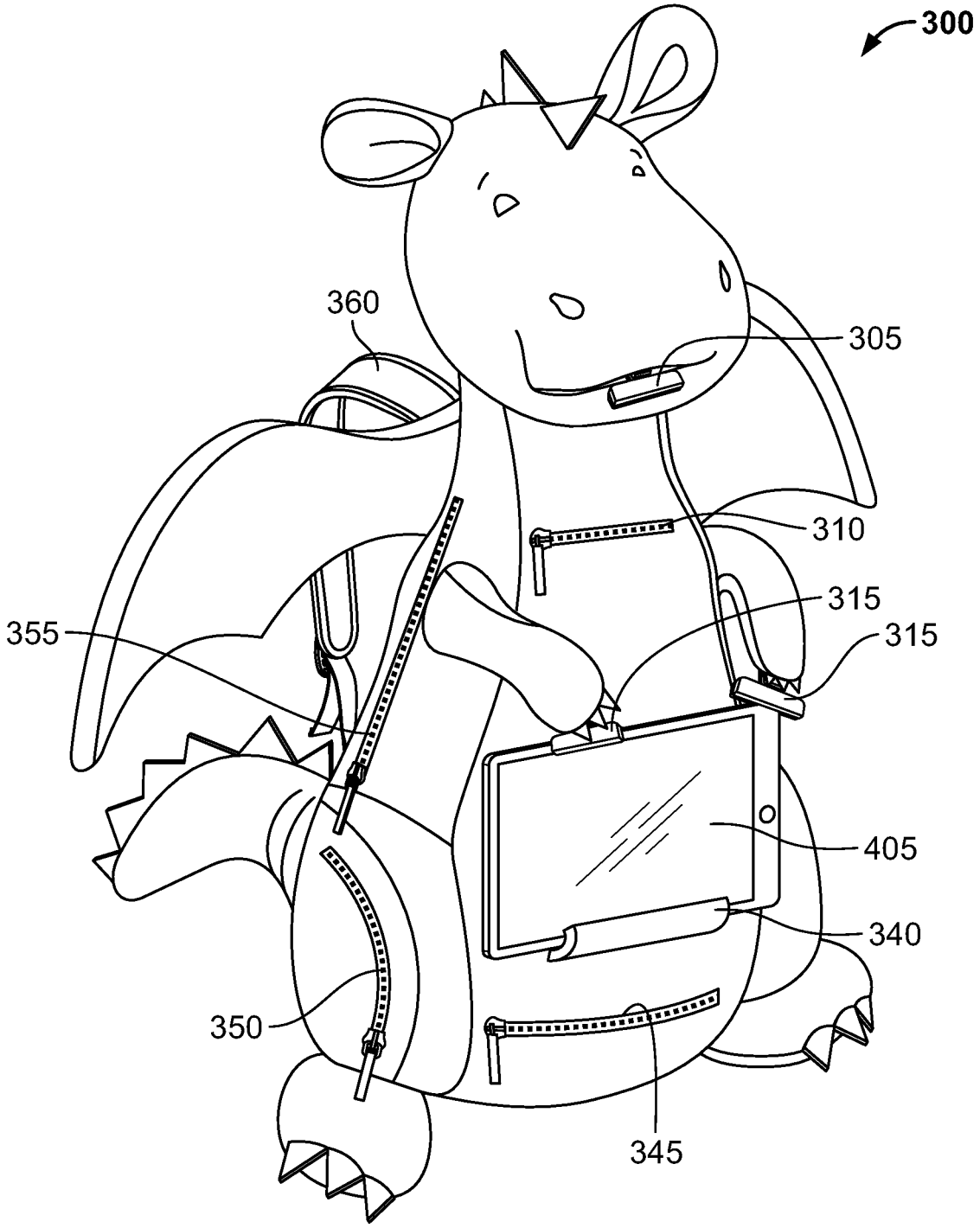
FIG. 4 shows another perspective view of the embodiment of FIG. 3 including a mobile screen device.

FIG. 4 shows an embodiment of electronic screen holder device 300 holding a mobile screen device 405. As shown in FIG. 4, tabs sliding connector 340 is engaged with one edge of mobile screen device 405, and screen retainers 315 are connected to a second edge of mobile screen device 405 to secure mobile screen device 405 against electronic screen holder device 300. Note that the components associated with concave recess 320 and its associated cover 330 are not shown in FIG. 4.

Figure 5:
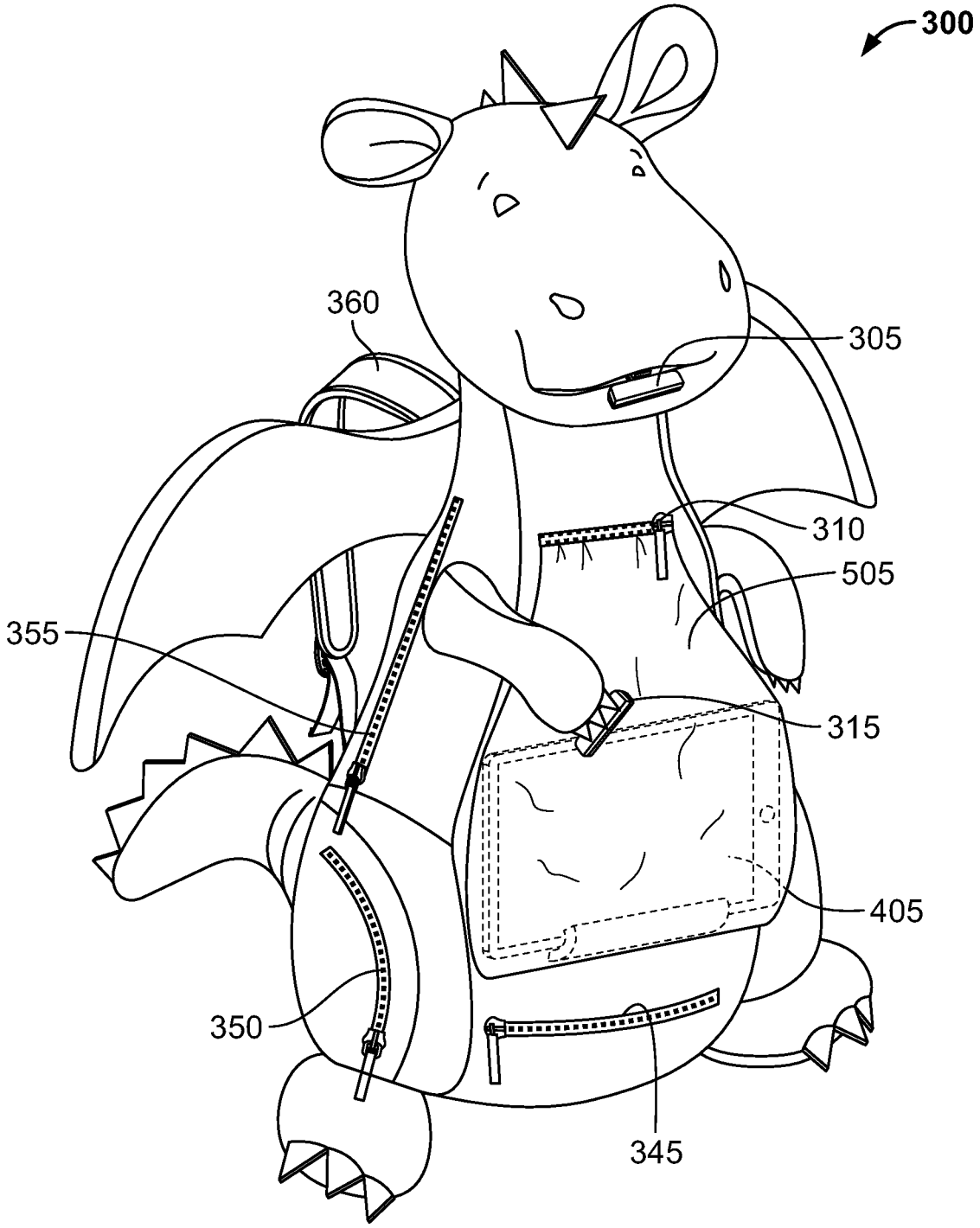
FIG. 5 shows another perspective view of the embodiment of FIG. 4 including a flexible cover in the extended position.

Referring now to FIG. 5, certain embodiments of electronic screen holder device 300 may include flexible cover 505 for covering mobile screen device 405 during transportation and storage. As shown in FIG. 5, pocket 310 contains flexible cover 505, which may optionally be extended from pocket 310. Flexible cover 505 may be elastic, neoprene, or other similar resilient materials. As shown in FIG. 5, flexible cover 505 may be stretched to cover mobile screen device 405. In some embodiments, flexible cover may engage with sliding connector 340 to secure flexible cover in the open position. In other embodiments, flexible cover 505 may be secured in the open position through the use of clips, magnets, or hook-and-loop fasteners.

In use, the embodiments depicted in FIGS. 1-5 can be manipulated by a user to secure, store, and access a mobile screen device. In one example, during operation a user may open a cover 110 of a concave recess 130 and secure the cover in the open position using cover retaining clip 105. A user may then insert a mobile screen device 205 into screen holder 140 of concave recess 130. The user may secure mobile screen device 205 to screen holder 140 with tabs 135. The user may then close cover 110 of concave recess 130 and transport the electronic screen holder device to another location. As another step, the user may further secure a second screen 405 to the electronic screen holder device by sliding a first edge the second screen 405 into sliding connector 340 and securing a second edge of the second screen 405 with screen retainers 315.

A number of embodiments have been described. Nevertheless, it will be understood that various modifications may be made without departing from the scope of the following claims.

What is claimed is:

1. A method of securing a mobile screen device in an electronic screen device holder comprising:

opening a retractable cover of an electronic screen holder device to access a recess defined by a body of the electronic screen holder device; attaching the retractable cover to a cover retaining clip for securing one edge of the retractable cover and holding the retractable cover when the retractable cover is in the open position; securing the mobile screen device to electronic screen connector tabs located within the recess; and closing the retractable cover of the electronic screen holder device.

2. The method of claim 1, further comprising:

rotating the mobile screen device relative to the recess from a first position to a second position while the mobile screen device is secured to the screen connector tabs.

3. The method of claim 1, further comprising:

sliding a first edge of a second mobile screen device into a sliding insert of the electronic screen holder device; and attaching a plurality of retainer clips to a second edge of the second mobile screen device.

4. The method of claim 3 further comprising extending a flexible cover and covering the second mobile screen device with the flexible cover.

5. The method of claim 4, wherein the flexible cover is extended from a recessed compartment for holding the second retractable cover when the second retractable cover is in a recessed position.

6. The method of claim 3, wherein the electronic screen holder device comprises a plurality of storage compartments.

7. The method of claim 6, wherein the electronic screen holder device further comprising a plurality of carrying straps.

8. A children's stuffed animal electronic screen holder device comprising:

a body, having a head portion, torso portion, two leg portions, and two arm portions;

a recess located in the torso portion;

mobile screen device connector tabs located within the recess for securing a mobile screen device to the body;

a retractable cover releasably attached to the recess;

a cover retaining clip located on the head portion for securing one edge of the retractable cover and holding the retractable cover when the retractable cover is in the open position;

a slidable insert for securing an edge of a second mobile screen device to the torso portion.

9. The children's stuffed animal screen holder device of claim 8, wherein the mobile screen device connector tabs are connected to a ratchet located within the recess.

10. The children's stuffed animal screen holder device of claim 8, further comprising second mobile screen device connector tabs located external to the recess for securing a second edge of the second mobile screen device to the torso, wherein the second mobile screen device connector tabs are located on the arm portions.

11. The children's stuffed animal screen holder device of claim 8, further comprising a second retractable cover releasably attached to the slidable insert.

12. The children's stuffed animal screen holder device of claim 8, wherein the body further defines a recessed compartment in the torso portion for holding the second retractable cover when the second retractable cover is in the recessed position.

13. The children's stuffed animal screen holder device of claim 8, wherein the body further defines a plurality of storage compartments in the leg portions.

* * * * *